US010434772B2

(12) United States Patent
Umeda et al.

(10) Patent No.: US 10,434,772 B2
(45) Date of Patent: Oct. 8, 2019

(54) PRINTHEAD AND PRINTING APPARATUS

(71) Applicant: CANON KABUSHIKI KAISHA, Tokyo (JP)

(72) Inventors: Kengo Umeda, Tokyo (JP); Satoshi Kimura, Kawasaki (JP); Shingo Okushima, Kawasaki (JP); Satoshi Oikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/995,613

(22) Filed: Jun. 1, 2018

(65) Prior Publication Data

US 2018/0361739 A1 Dec. 20, 2018

(30) Foreign Application Priority Data

Jun. 19, 2017 (JP) ..... 2017-119889

(51) Int. Cl.

| | |
|---|---|
| ***B41J 2/05*** | (2006.01) |
| ***B41J 2/18*** | (2006.01) |
| ***B41J 2/175*** | (2006.01) |
| ***B41J 29/13*** | (2006.01) |
| ***B41J 29/38*** | (2006.01) |
| ***B41J 2/045*** | (2006.01) |
| ***B41J 2/14*** | (2006.01) |

(52) U.S. Cl.

CPC ..... *B41J 2/05* (2013.01); *B41J 2/0458* (2013.01); *B41J 2/04541* (2013.01); *B41J 2/14153* (2013.01); *B41J 2/175* (2013.01); *B41J 2/1752* (2013.01); *B41J 2/17509* (2013.01); *B41J 2/18* (2013.01); *B41J 29/13* (2013.01); *B41J 29/38* (2013.01)

(58) Field of Classification Search

CPC .. B41J 2/04541; B41J 2/0458; B41J 2/14153; B41J 2/175; B41J 2/17509; B41J 2/1752; B41J 2/18; B41J 2/05

See application file for complete search history.

(56) References Cited

U.S. PATENT DOCUMENTS 6,431,678 B2 * 8/2002 Beck ..... B41J 2/14153 347/19

FOREIGN PATENT DOCUMENTS

JP 2008-195027 A 8/2008

* cited by examiner

*Primary Examiner* — Lamson D Nguyen
(74) *Attorney, Agent, or Firm* — Venable LLP

(57) ABSTRACT

A printhead comprises a print element substrate that includes a print element and a circuit board electrically connected to the print element substrate. An ink leakage detection unit, which includes a first electrode and a second electrode, and which is configured to detect ink leakage, is provided on the circuit board. At least one of the first electrode and the second electrode is electrically connected to a terminal of the print element substrate.

17 Claims, 13 Drawing Sheets

WHEN INK LEAKAGE DOES NOT OCCUR

WHEN INK LEAKAGE OCCURS

WHEN INK LEAKAGE OCCURS

WHEN INK LEAKAGE DOES NOT OCCUR

FIG. 10

| | ABNORMAL TEMPERATURE RISE/ TEMPERATURE DROP | INK LEAKAGE/ADHESION | TERMINAL VOLTAGE VS | POWER SUPPLY CIRCUIT |
|---|---|---|---|---|
| NORMAL STATE | NOT OCCURRED | NOT OCCURRED | NO CHANGE | OPERATION |
| ABNORMAL STATE 1 | OCCURRED | NOT OCCURRED | DECREASE (Va OR LOWER) | BLOCK |
| ABNORMAL STATE 2 | NOT OCCURRED | OCCURRED | DECREASE (Va OR LOWER) | BLOCK |
| ABNORMAL STATE 3 | OCCURRED | OCCURRED | DECREASE (Va OR LOWER) | BLOCK |

PRINTHEAD AND PRINTING APPARATUS

BACKGROUND OF THE INVENTION

Field of the Invention

The present invention relates to a printhead and a printing apparatus.

Description of the Related Art

Conventionally, there is known an inkjet printhead that discharges ink from a plurality of orifices by using thermal energy. In the inkjet printhead, the discharge characteristics of ink droplets from the orifices and a substrate temperature are closely related to each other. Therefore, a temperature detection element is built in a printhead element substrate to read the temperature of the element substrate at a high accuracy (for example, Japanese Patent Laid-Open No. 2008-195027). This temperature detection element is used in a case in which, for example, some abnormality such as a short circuit in power supply wiring line occurs on a substrate, and power is shut down forcibly when a temperature rises abnormally and plays a role in improving the reliability of the printhead.

In recent years, in order to achieve higher-speed printing and higher-resolution printing, it becomes necessary to increase the number of nozzles arrayed on the element substrate and the number of nozzles driven simultaneously. Along with this, a current flowing at the time of the printing operation increases to a several A (ampere) order. In order to suppress a fluctuation in power supply voltage of the element substrate, an electronic component such as a capacitor or a power supply IC is arranged near the element substrate.

However, the printhead element substrate is arranged near an ink supply member, and thus when the electronic component is arranged near the element substrate, a short circuit in power supply may be caused by ink adhesion owing to an ink leakage from the ink supply member. At this time, a power supply circuit or a head may be damaged if a power supply is applied continuously without noticing the short circuit in power supply by the ink adhesion. It is therefore necessary to detect the ink leakage and ink adhesion quickly. It is difficult, however, to detect the short circuit in power supply by the ink adhesion with the above-described temperature detection element.

SUMMARY OF THE INVENTION

The present invention makes it possible to detect an ink leakage and ink adhesion, implementing high reliability.

According to one aspect of the present invention, there is provided a printhead comprising: a print element substrate that includes a print element; and a circuit board electrically connected to the print element substrate, wherein an ink leakage detection unit including a first electrode and a second electrode, and configured to detect an ink leakage is provided on the circuit board, and at least one of the first electrode and the second electrode is electrically connected to a terminal of the print element substrate.

According to another aspect of the present invention, there is provided a printing apparatus comprising: a printhead; and a control board electrically connected to the printhead, wherein the printhead comprises: a print element substrate that includes a print element; and a circuit board electrically connected to the print element substrate, wherein an ink leakage detection unit including a first electrode and a second electrode, and configured to detect an ink leakage is provided on the circuit board, and at least one of the first electrode and the second electrode is electrically connected to a terminal of the print element substrate, wherein the print element substrate includes a temperature detection unit configured to detect a temperature of the print element substrate, and the temperature detection unit includes a first terminal and a second terminal, and the first electrode of the ink leakage detection unit is connected to the first terminal of the temperature detection unit, and the second electrode is connected to the second terminal, wherein the control board includes a control circuit and a power supply circuit configured to generate a power supply voltage applied to the printhead, and the control circuit blocks an output of the power supply circuit if a potential difference between a first terminal and a second terminal of a temperature detection unit falls outside a predetermined range.

According to another aspect of the present invention, there is provided a printing apparatus comprising: a printhead; and a control board electrically connected to the printhead, wherein the printhead comprises: a print element substrate that includes a print element; and a circuit board electrically connected to the print element substrate, wherein an ink leakage detection unit including a first electrode and a second electrode, and configured to detect an ink leakage is provided on the circuit board, and at least one of the first electrode and the second electrode is electrically connected to a terminal of the print element substrate, wherein the print element substrate includes a driving element configured to drive the print element, a control gate configured to control the driving element, and a logic circuit configured to send a control signal to the control gate, the first electrode of the ink leakage detection unit is connected to a power supply terminal of the logic circuit, and the second electrode of the ink leakage detection unit is connected to a ground terminal of the logic circuit, wherein the control board includes a leakage current detection circuit and a power supply circuit configured to generate a power supply voltage applied to the printhead, and the leakage current detection circuit blocks an output of the power supply circuit if a current at a power supply terminal of the logic circuit falls outside a predetermined range.

According to another aspect of the present invention, there is provided a printing apparatus comprising: a printhead; and a control board electrically connected to the printhead, wherein the printhead comprises: a print element substrate that includes a print element; and a circuit board electrically connected to the print element substrate, wherein an ink leakage detection unit including a first electrode and a second electrode, and configured to detect an ink leakage is provided on the circuit board, and at least one of the first electrode and the second electrode is electrically connected to a terminal of the print element substrate, wherein the print element substrate includes a driving element configured to drive the print element, a control gate configured to control the driving element, and a logic circuit configured to send a control signal to the control gate, and the first electrode of the ink leakage detection unit is connected to a power supply terminal of the control gate, and the second electrode of the ink leakage detection unit is connected to a ground terminal of the control gate, wherein the control board includes a leakage current detection circuit and a power supply circuit configured to generate a power supply voltage applied to the printhead, and the leakage current detection circuit blocks an output of the power supply circuit if a current at a power supply terminal of a control gate falls outside a predetermined range.

According to another aspect of the present invention, there is provided a printing apparatus comprising: a printhead; and a control board electrically connected to the printhead, wherein the printhead includes a print element substrate that includes a detection unit configured to detect a state of a print element substrate, and a circuit board that includes an ink leakage detection unit configured to detect an ink leakage, and electrically connected to the print element substrate and the control board, the control board includes a control circuit and a power supply circuit configured to generate a power supply voltage applied to the printhead, and based on a change in output of the ink leakage detection unit and a change in output by the detection unit, the control circuit can control an output of the power supply circuit.

According to the present invention, it is possible to detect the ink leakage and the ink adhesion at low cost and to achieve high reliability.

Further features of the present invention will become apparent from the following description of exemplary embodiments (with reference to the attached drawings).

BRIEF DESCRIPTION OF THE DRAWINGS

FIG. 10 is a table for explaining an operation in an abnormal state of the printing apparatus according to the present invention;

DESCRIPTION OF THE EMBODIMENTS

In this specification, the term "printing" (to be also referred to as "print" hereinafter) not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

In addition, the term "printing medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "printing (print)" described above. That is, "ink" includes a liquid which, when provided onto a printing medium, can form images, figures, patterns, and the like, can process the printing medium, or can process ink (for example, solidify or insolubilize a coloring agent contained in ink provided to the printing medium).

Further, a "printing element" generically means an orifice or a liquid channel communicating with it, and an element for generating energy used to discharge ink, unless otherwise specified.

Further, a "nozzle" generically means an orifice or a liquid channel communicating with it, and an element for generating energy used to discharge ink, unless otherwise specified.

A printhead element substrate (head substrate) used below means not merely a base made of a silicon semiconductor, but an arrangement in which elements, wiring lines, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

The printhead according to the present invention will be explained in an example in which a printing apparatus including a full-line printhead whose printing width corresponds to the width of a printing medium is used. Note that the present invention is not limited to this, and may be used for a printing apparatus including a serial type printhead if a problem to be solved by the present invention may arise due to the length of a wiring line or the like.

Overview of Printing Apparatus

Figure 1:
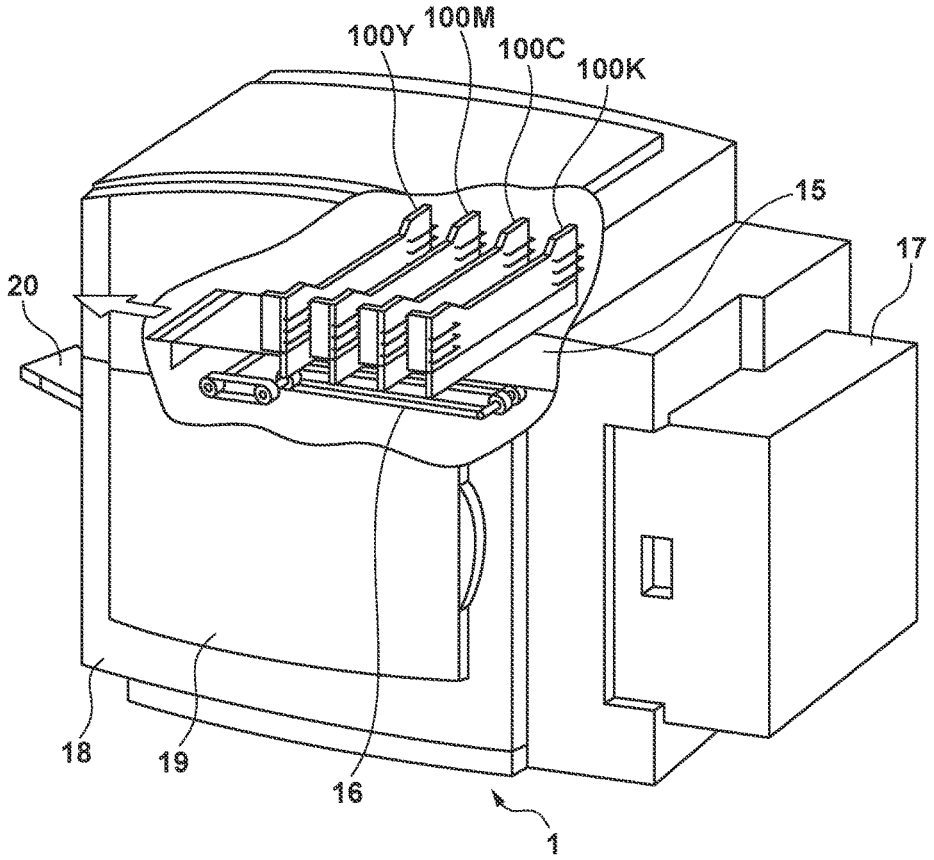
FIG. 1 is a perspective view showing an example of the outer appearance of an inkjet printing apparatus.

FIG. 1 is a perspective view for explaining the structure of a printing apparatus 1 which includes full-line inkjet printheads (to be referred to as printheads hereinafter) 100K, 100C, 100M, and 100Y and a recovery unit configured to guarantee ink discharge that is always stable. Note that a description will be given below by taking the printheads corresponding to four inks as an example. However, the present invention is not limited to this number. A common arrangement in the printheads is denoted as printheads 100 by omitting suffixes.

In the printing apparatus 1, a printing medium 15 is supplied from a feeder unit 17 to a print position by these printheads 100 and conveyed by a conveyance unit 16 included in a housing 18 of the printing apparatus 1.

In printing an image on the printing medium 15, black (K) ink is discharged from the printhead 100K when the reference position of the printing medium 15 reaches under the printhead 100K which discharges the black ink while conveying the printing medium 15. Similarly, when the printing medium 15 reaches respective reference positions in the order of the printhead 100C which discharges cyan (C) ink, the printhead 100M which discharges magenta (M) ink, and the printhead 100Y which discharges yellow (Y) ink, a color image is formed by discharging the inks of the respective colors. The printing medium 15 on which the image is thus printed is discharged to and stacked on a stacker tray 20.

The printing apparatus 1 further includes the conveyance unit 16, and ink cartridges (not shown) configured to supply the inks to the printheads 100K, 100C, 100M, and 100Y and replaceable for each ink. The printing apparatus 1 still further includes, for example, a pump unit (not shown) for a recovery operation and ink supply to the printheads 100, and a control board (not shown) which controls the entire printing apparatus 1. A front door 19 is an opening/closing door for replacing the ink cartridge.

Control Arrangement

Next, a control arrangement for executing printing control of the printing apparatus described with reference to FIG. 1 will be explained.

Figure 2:
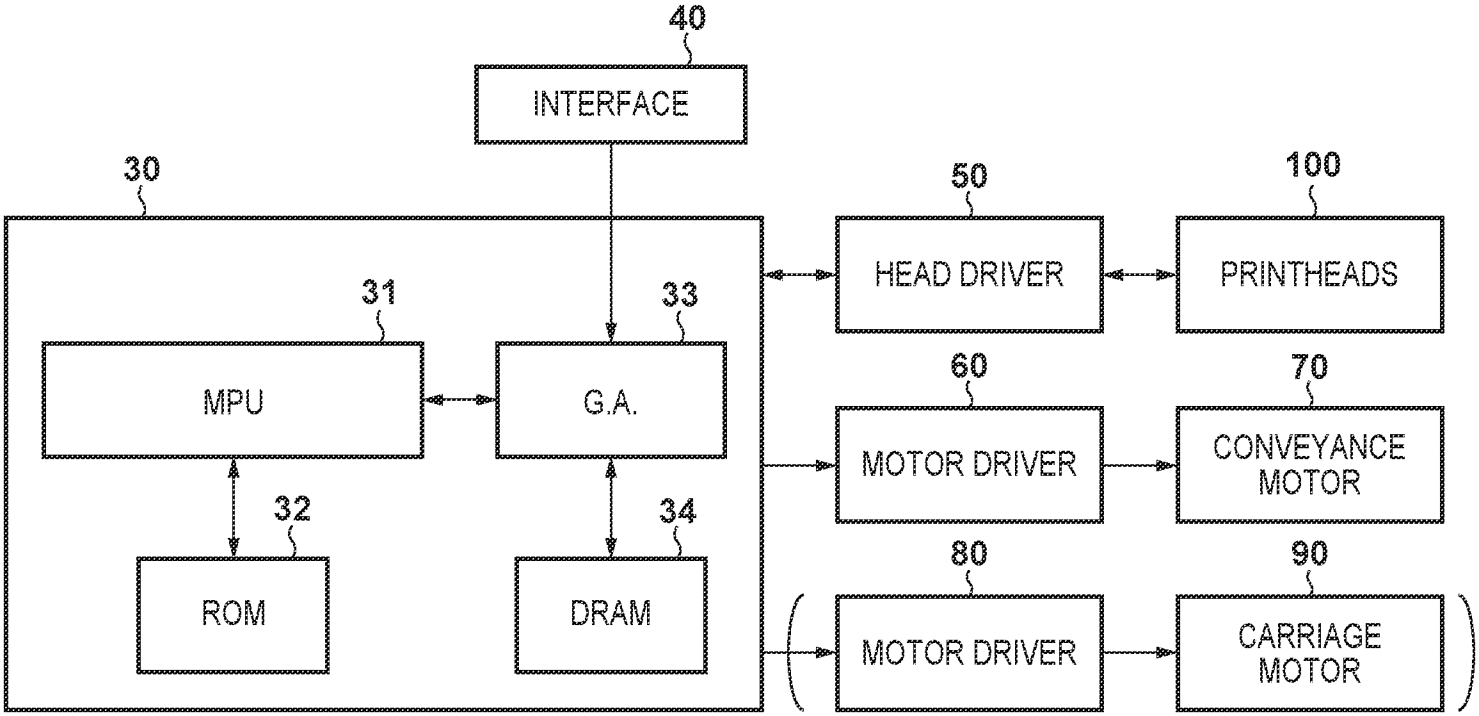
FIG. 2 is a block diagram showing an example of the control arrangement of the inkjet printing apparatus according to the present invention.

FIG. 2 is a block diagram showing the arrangement of the control circuit of the printing apparatus 1. In FIG. 2, a controller 30 includes an MPU 31, a ROM 32, a gate array (G.A.) 33, and a DRAM 34. An interface 40 is an interface for inputting print data. The ROM 32 is a non-volatile storage area and stores a control program executed by the MPU 31. The DRAM 34 is a DRAM for saving data such as print data, and a print signal to be supplied to each of the printheads 100. The gate array 33 is a gate array for controlling supply of a print signal to each of the printheads 100, and also controlling data transfer among the interface 40, the MPU 31, and the DRAM 34. A carriage motor 90 is a motor for conveying the printheads 100. A conveyance motor 70 is a motor for conveying a printing sheet. A head driver 50 drives the printheads 100. Motor drivers 60 and 80 are motor drivers for driving the conveyance motor 70 and the carriage motor 90, respectively.

Note that for the printing apparatus having the arrangement using the full-line printheads as shown in FIG. 1, the carriage motor 90 and the motor driver 80 for driving the motor are not arranged, so their reference numerals are parenthesized in FIG. 2.

The operation of the above control arrangement will be explained. When print data is input to the interface 40, it is converted into a print signal for printing between the gate array 33 and the MPU 31. Then, the motor drivers 60 and 80 are driven. At the same time, the printheads 100 are driven in accordance with the print data sent to the head driver 50, thereby performing printing.

First Embodiment

Figure 3:
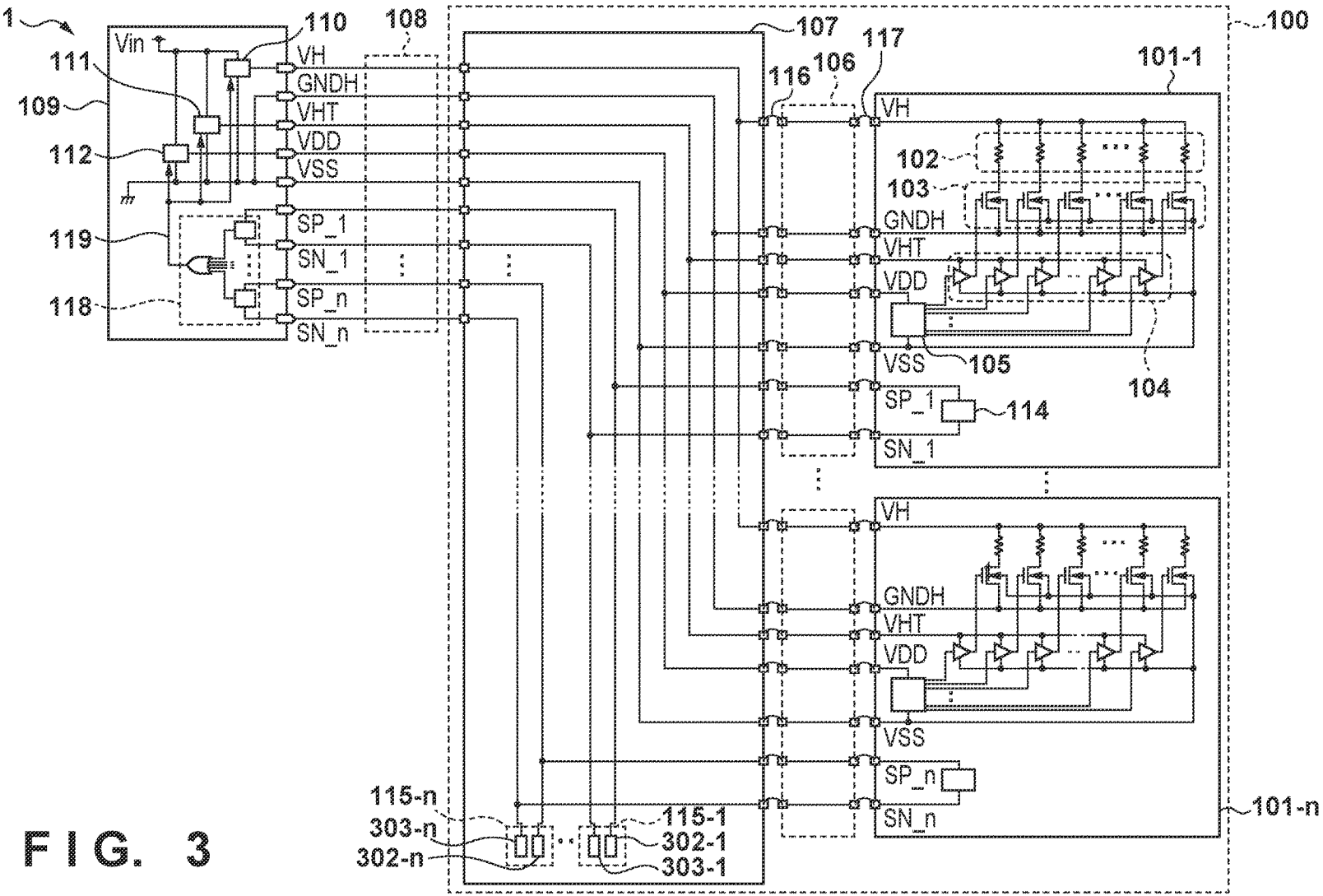
FIG. 3 is a circuit diagram showing an example of the arrangement of a printhead according to the first embodiment of the present invention.

FIG. 3 is a circuit diagram showing an example of the arrangement of a printhead 100 according to the first embodiment of the present invention. Note that in a case in which a plurality of same constituent elements are provided, reference numerals are shown with suffixes if a description is needed individually, and a description will be given while omitting the suffixes if a description is given generally.

The printhead 100 includes a plurality of print element substrates 101, a plurality of flexible boards 106, and a print circuit board 107. The print circuit board 107 is arranged as a rigid board. Each of the plurality of flexible boards 106 and the print circuit board 107 are electrically connected by first wire bonding 116. Each of the plurality of print element substrates 101 and the flexible boards 106 are electrically connected by second wire bonding 117. The print circuit board 107 is electrically connected to a head control board 109 arranged on the main body side of the printing apparatus 1 via a cable 108. As shown in FIG. 3, in each printhead 100 of this embodiment, the numbers of print element substrates 101, flexible boards 106, and print circuit board 107 are in the relation of n:n: 1.

Each print element substrate 101 will be explained in detail next. A heating resistor group 102 is formed by a plurality of heating resistors serving as print elements for heating and discharging ink. A driving element group 103 is formed by a plurality of driving elements that drive the heating resistor group 102. Field effect transistors (FETs) are mainly used as the driving elements. A control gate group 104 is formed by a plurality of control gates that control the driving element group 103. A logic circuit 105 is a logic circuit for sending a control signal to the control gate group 104. The logic circuit 105 is mainly formed by a latch circuit and a shift register circuit that hold print data, a heat enable (HE) generation circuit that generates an HE pulse for deciding a conducting time of each driving element, and the like.

Each temperature detection unit 114 is a detection unit configured to detect the temperature of the print element substrate 101, and a diode element or a resistive element is used. A positive-side terminal (SP) and negative-side terminal (SN) of the temperature detection unit 114 are connected to a temperature detection circuit 118 of the head control board 109 via the flexible board 106, the print circuit board 107, and the cable 108.

One end of each heating resistor is connected to a print element power supply (VH), and the other end is connected to the drain terminal of a corresponding one of the FETs serving as the driving elements. The source terminals of the driving elements are connected to a print element ground wiring line (GNDH), and the substrate terminals of the driving elements are connected to a substrate ground wiring line (VSS). The power supply of each control gate is connected to a control gate power supply wiring line (VHT). The power supply of the logic circuit 105 is connected to a logic circuit power supply wiring line (VDD). The ground terminals of the control gates and logic circuit 105 are connected to the substrate ground wiring line (VSS).

The print element power supply (VH) and print element ground (GNDH) for driving the print elements are generated in a power supply circuit 110 on the head control board 109. The control gate power supply (VHT) and the logic circuit power supply (VDD) are, respectively, generated in power supply circuits 111 and 112, and applied to the plurality of print element substrates 101 via the cable 108, the print circuit board 107, and the flexible boards 106. The temperature detection circuit 118 monitors a voltage (VS) of the temperature detection unit 114 provided in each of the plurality of print element substrates 101 and outputs a power supply stop signal 119 to the power supply circuits 110, 111, and 112 each generating a power supply voltage if the voltage (VS) exceeds a predetermined temperature range. If the power supply circuits 110, 111, and 112 receive the power supply stop signal 119, they stop outputs of the print element power supply (VH), control gate power supply (VHT), and logic circuit power supply (VDD). That is, each power supply circuit can control the output in accordance with the power supply stop signal.

Ink leakage detection units 115 are detection units each for detecting an ink leakage and are arranged on the print circuit board 107. Each ink leakage detection unit 115 is formed by a wiring layer of the print circuit board 107, and is made of the first electrode and the second electrode. In this embodiment, the ink leakage detection units 115 are provided in correspondence with the number of print element substrates 101 (temperature detection units 114). Here, n ink leakage detection units 115 are formed on the print circuit board 107.

Figure 4:
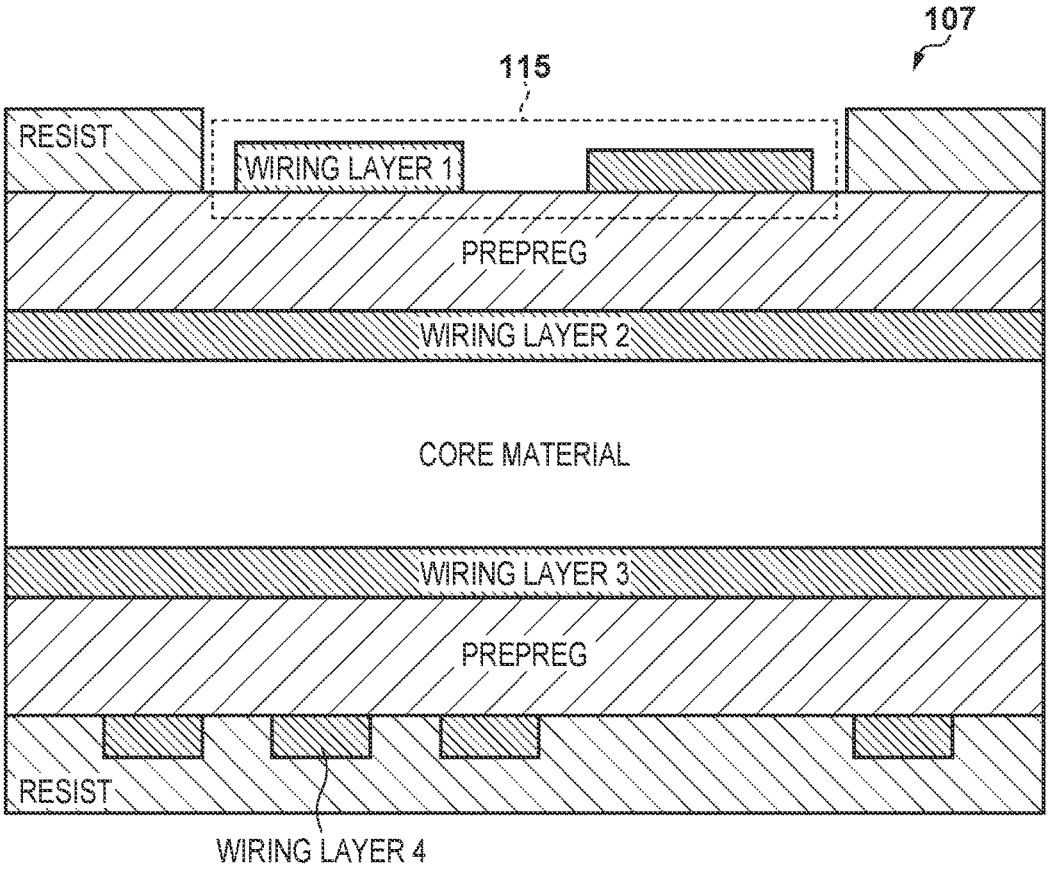
FIG. 4 is a view for explaining the section of the first circuit board in the printhead of the present invention.

FIG. 4 is a view representing the section of the print circuit board 107 and shows an example in which the print circuit board 107 is formed by a four-layered substrate. The ink leakage detection unit 115 is formed by wiring layer 1, and its electrodes are exposed with a resist being opened. Therefore, in the case of an ink leakage or the like, ink adheres to these electrodes directly. Note that the ink leakage detection unit 115 need not always be formed by uppermost wiring layer 1 but may be formed by lowermost wiring layer 4.

Figure 5:
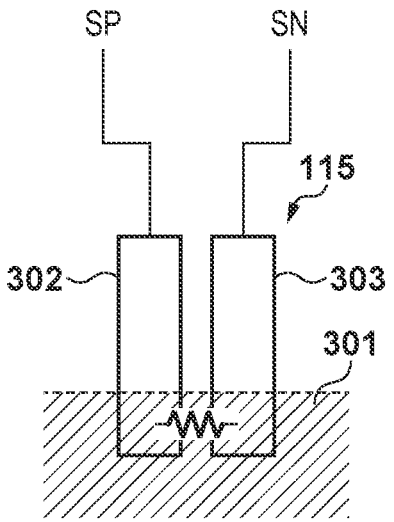
FIG. 5 is a view for explaining an ink detection method in an ink leakage detection unit of the present invention.

FIG. 5 is a view for explaining an ink detection unit of the ink leakage detection unit 115. Ink 301 contains water and has a low impedance, shorting a first electrode 302 and a second electrode 303 at low resistance at the time of an ink leakage or at the time of ink adhesion. Therefore, by monitoring a potential difference (resistance value) between the first electrode 302 and the second electrode 303, it becomes possible to detect the state. It is preferable that a distance between the first electrode 302 and second electrode 303 of the ink leakage detection unit 115 is shorter in order to detect the ink leakage/adhesion at a higher accuracy.

The first electrode 302 of the ink leakage detection unit 115 is connected to the positive-side terminal (SP) of the temperature detection unit 114, and the second electrode 303 is connected to the negative-side terminal (SN) of the temperature detection unit 114 (see FIG. 3). With such an arrangement, it becomes possible to detect an ink leakage/adhesion by using the temperature detection circuit 118. In other words, based on signals obtained from the plurality of temperature detection units 114 and the plurality of ink leakage detection units 115, the temperature detection circuit 118 detects a variation in temperature and the ink leakage/adhesion, and controls power supply to the printheads 100. That is, the temperature detection circuit 118 can be used to also detect the ink leakage/adhesion without providing a dedicated detection circuit for detecting the ink leakage/adhesion on the head control board 109. The terminals (SP and SN) of the temperature detection units 114 can be used to also detect the ink leakage/adhesion, eliminating the need for providing terminals for detecting the ink leakage/adhesion and making it possible to decrease the number of terminals. Furthermore, by setting the temperature detection circuit 118 to supply only a current as small as several hundred microamperes to each temperature detection unit 114, there is an advantage in restricting a flowing current and ensuring safety even if the first electrode 302 and the second electrode 303 are shorted when the ink leakage occurs.

Figure 6:
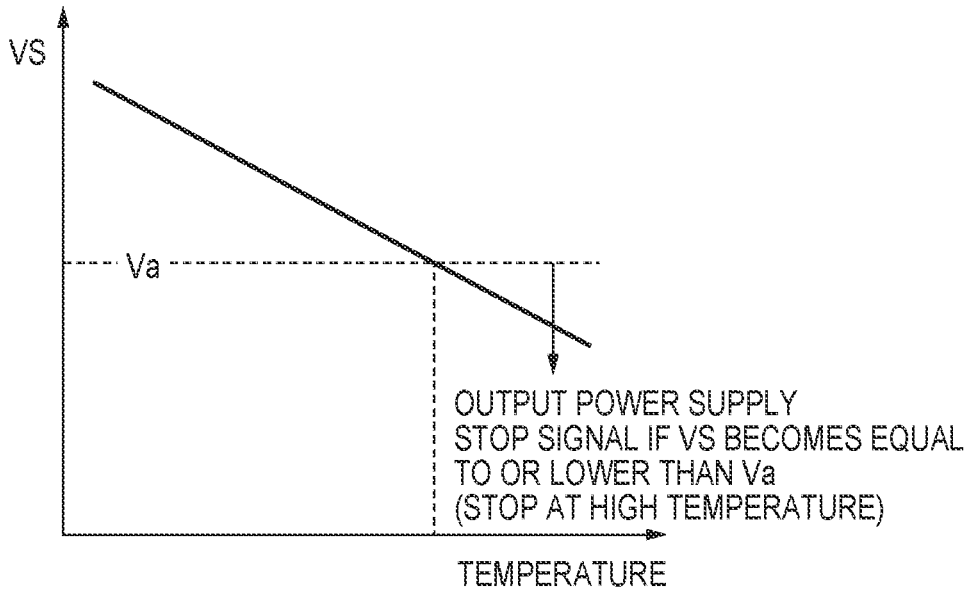
FIG. 6 is a graph for explaining the temperature characteristic of a temperature detection unit having a negative temperature characteristic.

FIG. 6 is a graph showing a temperature characteristic when a detection unit having a negative temperature characteristic is used for each temperature detection unit 114 according to this embodiment. Referring to FIG. 6, the ordinate indicates the terminal voltage (VS), and the abscissa indicates a temperature. For example, a diode or the like can be given as a temperature sensor having the negative temperature characteristic that the terminal voltage (VS) decreases with an increase in temperature. The temperature detection circuit 118 monitors the voltage (VS) of the temperature detection unit 114 provided in each of the plurality of print element substrates 101, and determines that the temperature increases to a predetermined temperature or higher and is in an abnormal state if the voltage (VS) becomes equal to or lower than a predetermined voltage (Va). Then, the temperature detection circuit 118 outputs the power supply stop signal 119 to the power supply circuits 110, 111, and 112 and blocks the outputs of the power supply circuits.

Figure 7B:
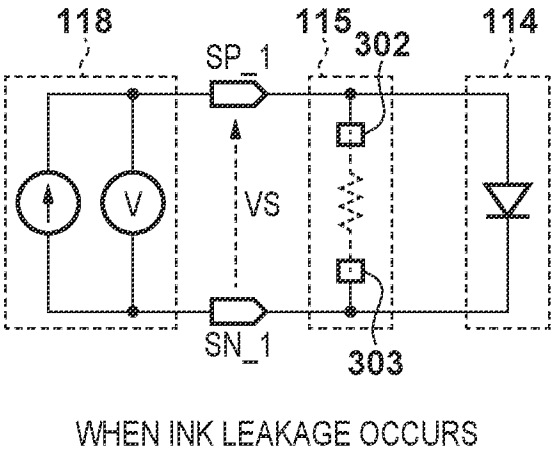
FIGS. 7A and 7B are diagrams each showing an equivalent circuit of the printhead when the temperature detection unit having the negative temperature characteristic is used.
Figure 7A:
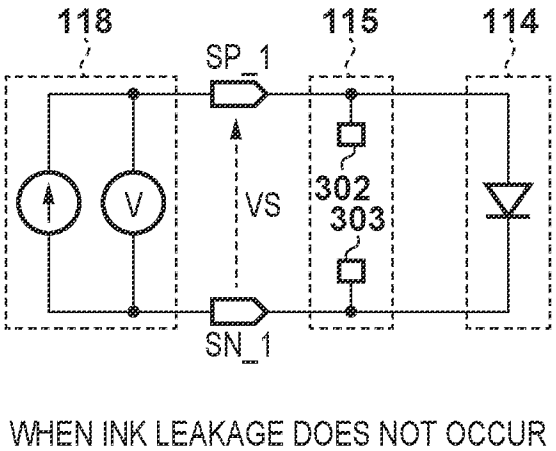

FIGS. 7A and 7B are diagrams each showing an equivalent circuit of the ink leakage detection unit 115 and the temperature detection unit 114 having the negative temperature characteristic. Here, the first electrode 302 of the ink leakage detection unit 115 is connected to the anode terminal of a diode serving as the temperature detection unit 114, and the second electrode 303 is connected to the cathode terminal. In this embodiment, by using a sensor having the negative temperature characteristic for the temperature detection unit 114, it is possible to use the ink leakage detection unit 115 and the temperature detection circuit 118 in combination. This principle will be explained with reference to FIGS. 7A and 7B.

FIG. 7A shows the equivalent circuit when an ink leakage does not occur, and FIG. 7B shows the equivalent circuit when the ink leakage occurs. When the ink leakage does not occur, the first electrode 302 and second electrode 303 of the ink leakage detection unit 115 are set in an open state. Consequently, the terminal voltage (VS) between the SP and the SN becomes the terminal voltage itself of the temperature detection unit 114 having the negative temperature characteristic. On the other hand, when the ink leakage occurs, the first electrode 302 and second electrode 303 of the ink leakage detection unit 115 are shorted at low resistance by ink. Consequently, the terminal voltage (VS) between the SP and the SN becomes equal to or lower than the predetermined voltage (Va). The temperature detection circuit 118 detects this change in voltage, outputting the power supply stop signal 119 from the temperature detection circuit 118 and blocking the outputs of the power supply circuits 110, 111, and 112. By thus making terminal voltage change directions at the time of an abnormal temperature rise and at the time of the ink leakage equal to each other, the temperature detection circuit 118 can be used to also detect the ink leakage.

Figure 8:
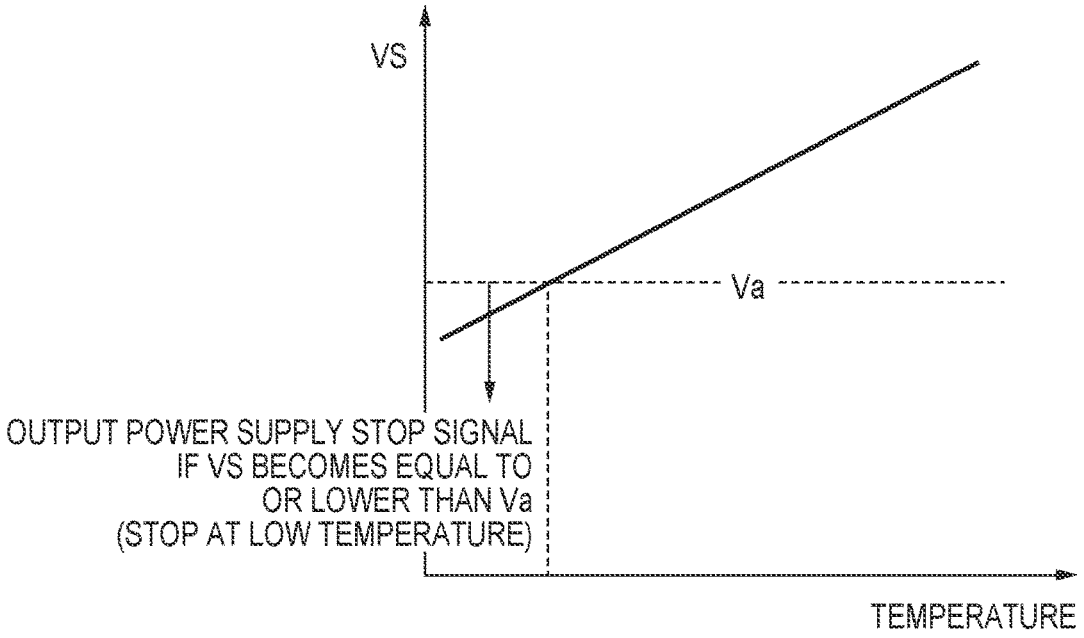
FIG. 8 is a graph for explaining the temperature characteristic of a temperature detection unit having a positive temperature characteristic.

FIG. 8 is a graph showing a temperature characteristic when a detection unit having a positive temperature characteristic is used for each temperature detection unit 114 according to this embodiment. Referring to FIG. 8, the ordinate indicates the terminal voltage (VS), and the abscissa indicates a temperature. For example, a resistive element or the like can be given as a temperature sensor having the positive temperature characteristic that the terminal voltage (VS) increases with an increase in temperature. The resistive element is often formed on the print element substrate by using a wiring material such as aluminum. The temperature detection circuit 118 monitors the voltage (VS) of the temperature detection unit 114 provided in each of the plurality of print element substrates 101, and determines that the temperature decreases to a predetermined temperature or lower and is in an abnormal state if the voltage (VS) becomes equal to or lower than the predetermined voltage (Va). Then, the temperature detection circuit 118 outputs the power supply stop signal 119 to the power supply circuits 110, 111, and 112 and blocks the outputs of the power supply circuits.

Note that in the above-described example, the voltage (Va) is set as a predetermined threshold. However, the present invention is not limited to this. For example, an upper limit and a lower limit may be set as a predetermined range for a voltage to be monitored, and an abnormal state may be determined if the voltage falls outside the range.

Figure 9B:
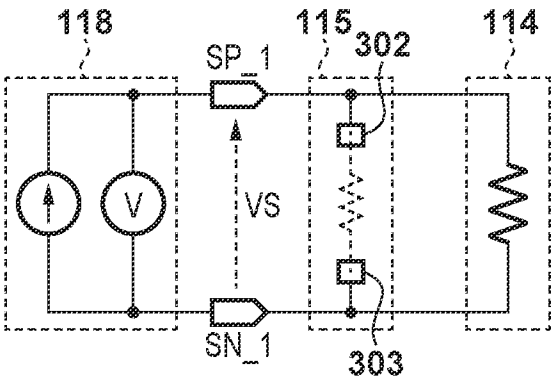
FIGS. 9A and 9B are diagrams each showing an equivalent circuit of the printhead when the temperature detection unit having the positive temperature characteristic is used.
Figure 9A:
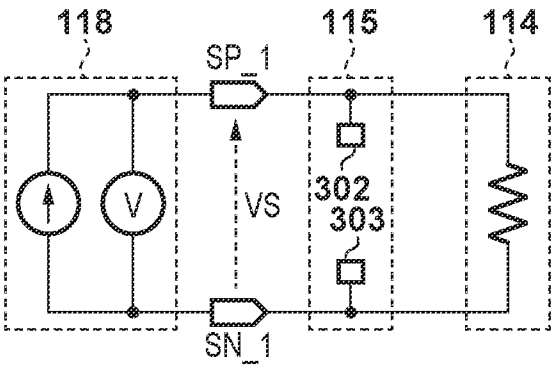

FIGS. 9A and 9B are diagrams each showing an equivalent circuit of the ink leakage detection unit 115 and the temperature detection unit 114 having the positive temperature characteristic. In this embodiment, the ink leakage detection unit 115 and the temperature detection circuit 118 can be used in combination even if the sensor having the positive temperature characteristic is used for the temperature detection unit 114. This principle will be explained with reference to FIGS. 9A and 9B.

FIG. 9A shows the equivalent circuit when an ink leakage does not occur, and FIG. 9B shows the equivalent circuit when the ink leakage occurs. When the ink leakage does not occur, the first electrode 302 and second electrode 303 of the ink leakage detection unit 115 are set in an open state. Consequently, the terminal voltage (VS) between the SP and the SN becomes the terminal voltage itself of the temperature detection unit 114 having the positive temperature characteristic. On the other hand, when the ink leakage occurs, the first electrode 302 and second electrode 303 of the ink leakage detection unit 115 are shorted at low resistance by ink. Consequently, the terminal voltage (VS) between the SP and the SN becomes equal to or lower than the predetermined voltage (Va). The temperature detection circuit 118 detects this change in voltage, outputting the power supply stop signal 119 from the temperature detection circuit 118 and blocking the outputs of the power supply circuits 110, 111, and 112. By thus making terminal voltage change directions at the time of an abnormal temperature drop and at the time of the ink leakage equal to each other, the temperature detection circuit 118 can be used to also detect the ink leakage.

FIG. 10 is a table showing an operation in an abnormal state of the printing apparatus according to this embodiment. It is found that an abnormal state can be detected in one detection circuit, and a power supply circuit can be interrupted to bring the printing apparatus to a safe state regardless of whether an abnormal temperature rise and an abnormal temperature drop, and an ink leakage occur separately or occur simultaneously.

With the above arrangement, the printheads according to this embodiment can detect an ink leakage and ink adhesion at low cost, making it possible to prevent damage to a power supply circuit or a head. As a result, it is possible to provide printheads and a printing apparatus that achieve high reliability.

Second Embodiment

Figure 11:
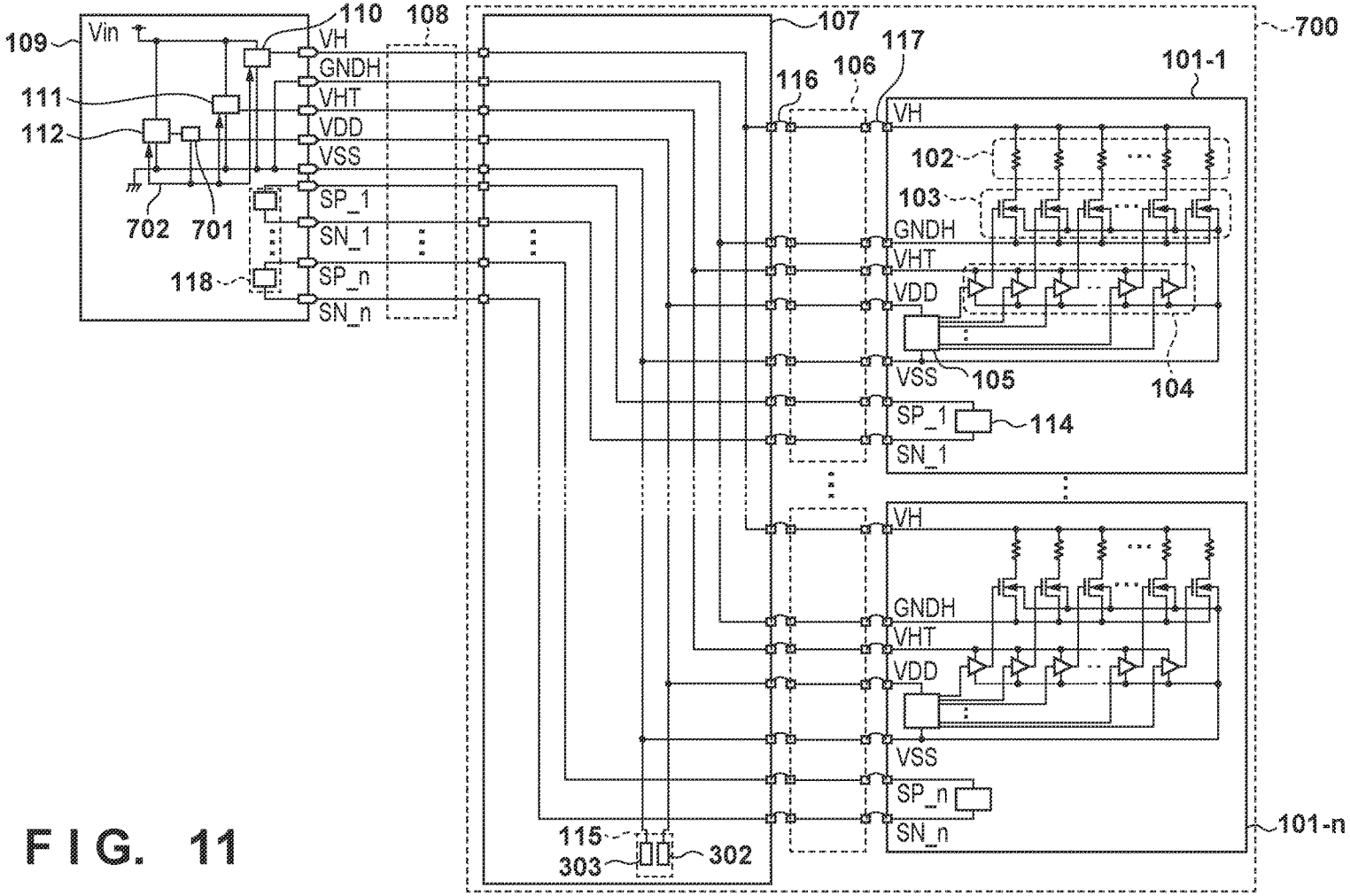
FIG. 11 is a circuit diagram showing an example of the arrangement of a printhead according to the second embodiment.

FIG. 11 is a circuit diagram showing an example of the arrangement of a printhead 700 according to the second embodiment of the present invention. A difference from the first embodiment is that a first electrode 302 of an ink leakage detection unit 115 is connected to a logic circuit power supply wiring line (VDD), and a second electrode 303 is connected to a substrate ground wiring line (VSS). Unlike the first embodiment, one ink leakage detection unit 115 is formed on a print circuit board 107 in this embodiment. Furthermore, a VDD leakage current detection circuit 701 is provided on a head control board 109. The VDD leakage current detection circuit 701 monitors the current of the logic circuit power supply (VDD) and determines an abnormal state if the current becomes equal to or larger than a predetermined current value. Then, if the VDD leakage current detection circuit 701 determines the abnormal state, it outputs a power supply stop signal 702 to power supply circuits 110, 111, and 112 and blocks the outputs of the power supply circuits.

In the printhead 700 according to the second embodiment, the first electrode 302 of the ink leakage detection unit 115 is connected to the VDD, and the second electrode 303 is connected to the VSS. This makes it possible to detect an ink leakage/adhesion by using the VDD leakage current detection circuit 701. That is, the VDD leakage current detection circuit 701 can be used to also detect the ink leakage/adhesion without providing a dedicated detection circuit for detecting the ink leakage/adhesion on the head control board 109. The logic circuit power supply terminal (VDD) can be used to also detect the ink leakage/adhesion, eliminating the need for providing terminals for detecting the ink leakage/adhesion and making it possible to decrease the number of terminals. Furthermore, the ink leakage detection units 115 need not be formed in correspondence with the number of print element substrates 101, making it possible to reduce the size of a substrate as compared with the first embodiment.

Note that in this embodiment, an example in which one ink leakage detection unit 115 is formed on the print circuit board 107 has been described. However, the present invention is not limited to this. Two or more ink leakage detection units 115 may be formed and used, or the ink leakage detection unit 115 may be formed on each flexible board 106.

Third Embodiment

Figure 12:
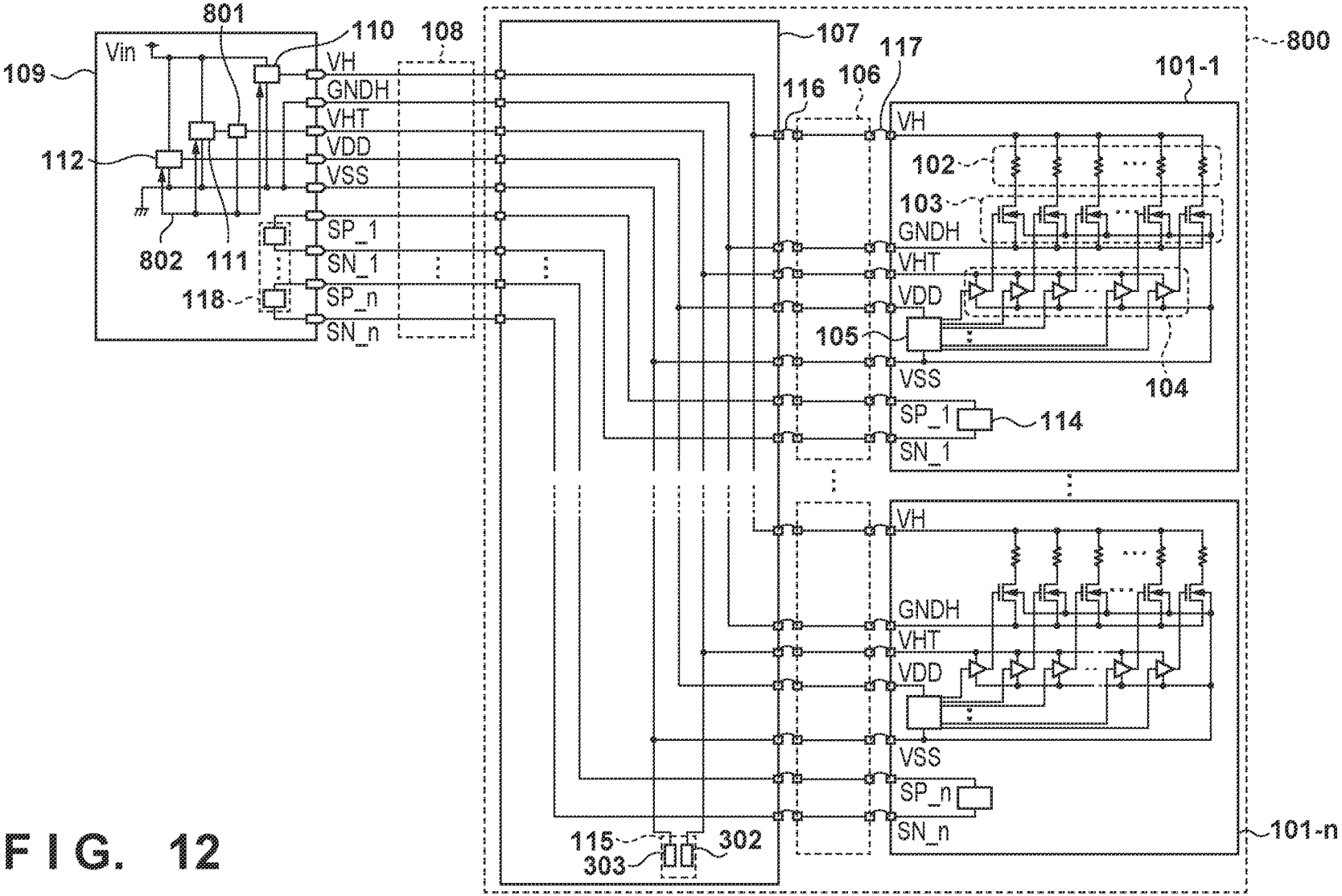
FIG. 12 is a circuit diagram showing an example of the arrangement of a printhead according to the third embodiment.

FIG. 12 is a circuit diagram showing an example of the arrangement of a printhead 800 according to the third embodiment of the present invention. A difference from the first embodiment is that a first electrode 302 of an ink leakage detection unit 115 is connected to a control gate power supply wiring line (VHT), and a second electrode 303 is connected to a substrate ground wiring line (VSS). Unlike the first embodiment, one ink leakage detection unit 115 is formed on a print circuit board 107 in this embodiment. Furthermore, a VHT leakage current detection circuit 801 is provided on a head control board 109. The VHT leakage current detection circuit 801 monitors the current of the control gate power supply (VHT) and determines an abnormal state if the current becomes equal to or larger than a predetermined current value. Then, if the VHT leakage current detection circuit 801 determines the abnormal state, it outputs a power supply stop signal 802 to power supply circuits 110, 111, and 112 and blocks the outputs of the power supply circuits.

In the printhead 800 according to the third embodiment, the first electrode 302 of the ink leakage detection unit 115 is connected to the VHT, and the second electrode 303 is connected to the VSS. This makes it possible to detect an ink leakage/adhesion by using the VHT leakage current detection circuit 801. That is, the VHT leakage current detection circuit 801 can be used to also detect the ink leakage/adhesion without providing a dedicated detection circuit for detecting the ink leakage/adhesion on the head control board 109. The control gate power supply terminal (VHT) can also be used to also detect the ink leakage/adhesion, eliminating the need for providing terminals for detecting the ink leakage/adhesion and making it possible to decrease the number of terminals. Furthermore, the ink leakage detection units 115 need not be formed in correspondence with the number of print element substrates 101, making it possible to reduce the size of a substrate as compared with the first embodiment.

Note that in this embodiment, an example in which one ink leakage detection unit 115 is formed on the print circuit board 107 has been described. However, the present invention is not limited to this. Two or more ink leakage detection units 115 may be formed and used, or the ink leakage detection unit 115 may be formed on each flexible board 106.

Fourth Embodiment

Figure 13:
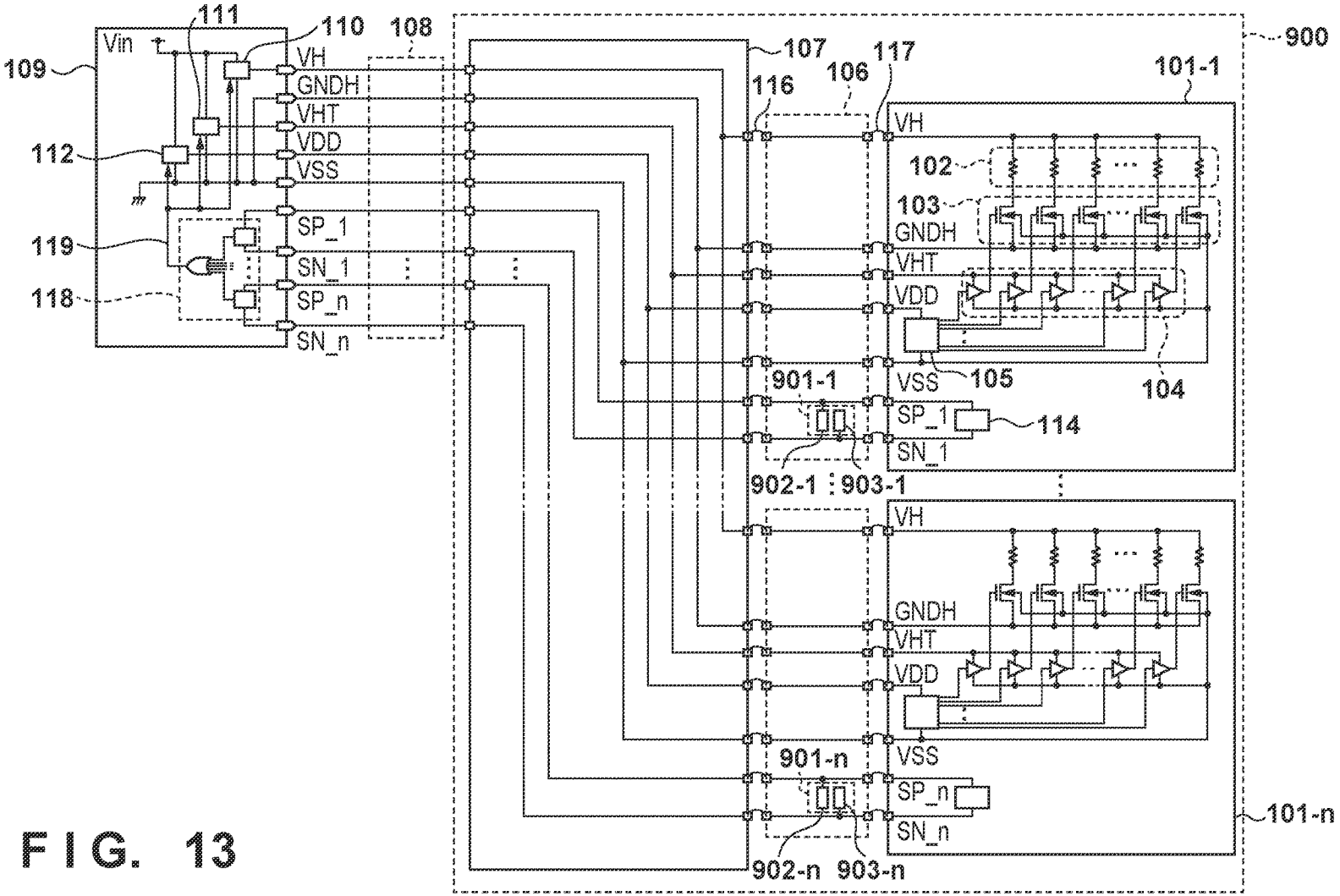
FIG. 13 is a circuit diagram showing an example of the arrangement of a printhead according to the fourth embodiment.

FIG. 13 is a circuit diagram showing an example of the arrangement of a printhead 900 according to the fourth embodiment of the present invention. A difference from the first embodiment is that ink leakage detection units 901 are provided on flexible boards 106. First electrodes 902 of the ink leakage detection units 901 are connected to positive-side terminals (SP) of temperature detection units 114, and second electrodes 903 are connected to negative-side terminals (SN) of the temperature detection units 114.

In this embodiment, the ink leakage detection units 901 are provided in correspondence with the number of print element substrates 101 (temperature detection units 114) and formed on the plurality of flexible boards 106 here. As in the arrangement shown in the first embodiment with reference to FIG. 4, the ink leakage detection units 901 are formed with their electrodes being exposed. Therefore, in the case of an ink leakage or the like, ink adheres to these electrodes directly.

The flexible boards 106 are located closer to the print element substrates 101 than a print circuit board 107, making it possible to detect an ink leakage/adhesion in an earlier stage than in the first embodiment.

Fifth Embodiment

Figure 14:
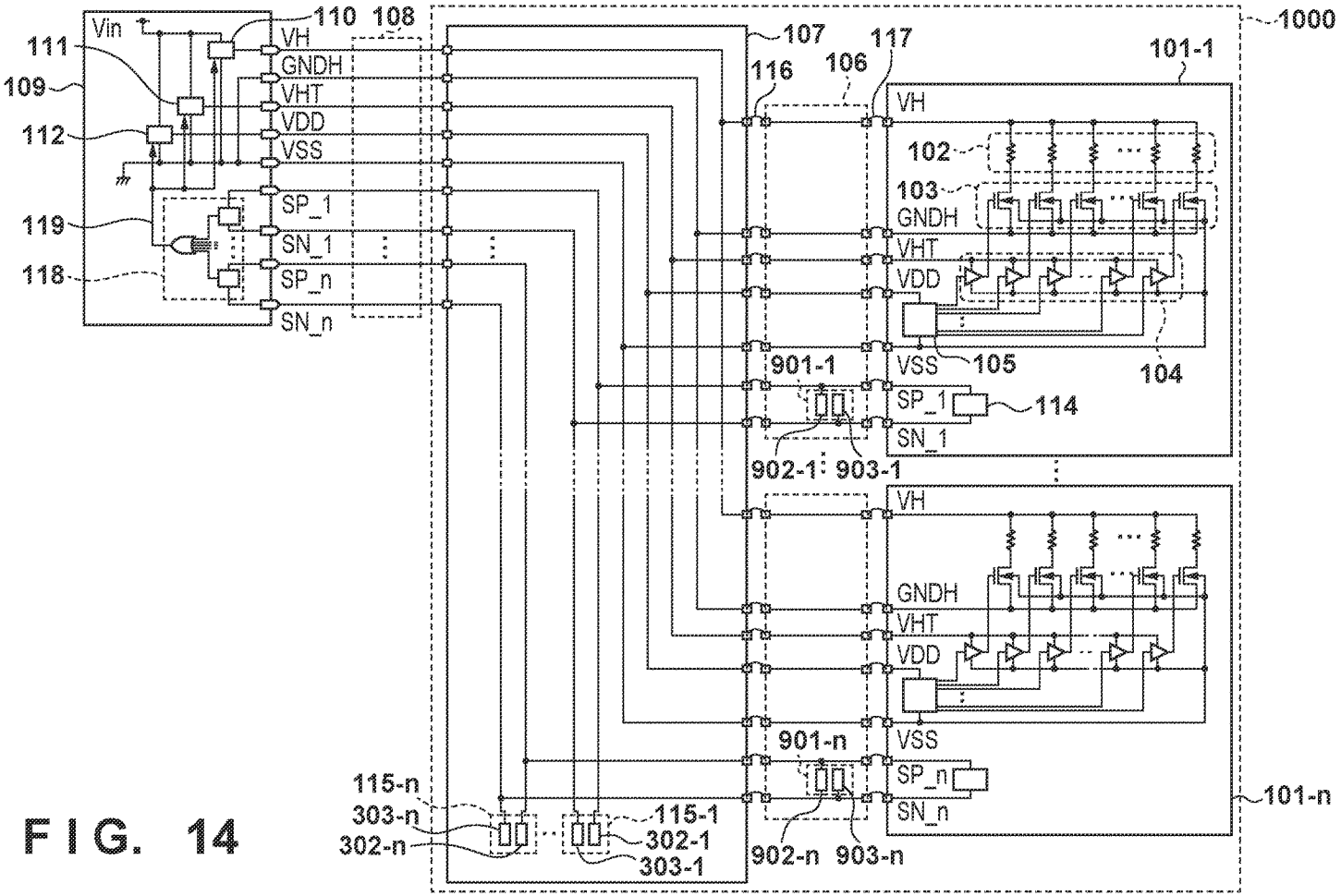
FIG. 14 is a circuit diagram showing an example of the arrangement of a printhead according to the fifth embodiment.

FIG. 14 is a circuit diagram showing an example of the arrangement of a printhead 1000 according to the fifth embodiment of the present invention. A difference from the first embodiment is that ink leakage detection units are provided on both a print circuit board 107 and flexible boards 106 (ink leakage detection units 115 and 901). First electrodes 302 and 902 of the ink leakage detection units 115 and 901 are connected to positive-side terminals (SP) of temperature detection units 114, and second electrodes 303 and 903 are connected to negative-side terminals (SN) of the temperature detection units 114.

In this embodiment, (2×n) ink leakage detection units are provided in total (the n ink leakage detection units 115 and the n ink leakage detection units 901).

By arranging the ink leakage detection units on both the print circuit board 107 and the flexible boards 106, it becomes possible to detect an ink leakage/adhesion at a higher accuracy than in the first embodiment.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-119889, filed Jun. 19, 2017, which is hereby incorporated by reference herein in its entirety.

What is claimed is:

1. A printhead comprising:

a print element substrate that includes a print element; and a circuit board electrically connected to the print element substrate, wherein an ink leakage detection unit that includes a first electrode and a second electrode and that is configured to detect ink leakage is provided on the circuit board, at least one of the first electrode and the second electrode is electrically connected to a terminal of the print element substrate, the circuit board includes:

a rigid circuit board electrically connected to the print element substrate, and a flexible circuit board that is arranged between the rigid circuit board and the print element substrate, and that is electrically connected to the print element substrate, and the ink leakage detection unit is provided on at least one of the rigid circuit board and the flexible circuit board.

2. The printhead according to claim 1, wherein the printhead is a full-line printhead having a printing width corresponding to a width of a print medium being used.

3. A printhead comprising:

a print element substrate that includes a print element; and a circuit board electrically connected to the print element substrate, wherein an ink leakage detection unit that includes a first electrode and a second electrode and that is configured to detect ink leakage is provided on the circuit board, the print element substrate includes a temperature detection unit configured to detect a temperature of the print element substrate, the temperature detection unit includes a first terminal and a second terminal, and the first electrode of the ink leakage detection unit is electrically connected to the first terminal of the temperature detection unit, and the second electrode of the ink leakage detection unit is electrically connected to the second terminal of the temperature detection unit.

4. The printhead according to claim 3, wherein the temperature detection unit has a negative temperature characteristic in which a terminal voltage decreases as temperature increases.

5. The printhead according to claim 4, wherein the temperature detection unit is a diode element.

6. The printhead according to claim 5, wherein the first terminal is an anode terminal of the diode element, and the second terminal is a cathode terminal of the diode element.

7. The printhead according to claim 3, wherein the temperature detection unit has a positive temperature characteristic in which a terminal voltage increases as temperature increases.

8. The printhead according to claim 7, wherein the temperature detection unit is a resistive element.

9. A printhead comprising:

a print element substrate that includes a print element; and a circuit board electrically connected to the print element substrate, wherein an ink leakage detection unit that includes a first electrode and a second electrode and that is configured to detect ink leakage is provided on the circuit board, the print element substrate includes a driving element configured to drive the print element, a control gate configured to control the driving element, and a logic circuit configured to send a control signal to the control gate, the first electrode of the ink leakage detection unit is electrically connected to a power supply terminal of the logic circuit, and the second electrode of the ink leakage detection unit is electrically connected to a ground terminal of the logic circuit.

10. A printhead comprising:

a print element substrate that includes a print element; and a circuit board electrically connected to the print element substrate, wherein an ink leakage detection unit that includes a first electrode and a second electrode and that is configured to detect ink leakage is provided on the circuit board, the print element substrate includes a driving element configured to drive the print element, a control gate configured to control the driving element, and a logic circuit configured to send a control signal to the control gate, the first electrode of the ink leakage detection unit is electrically connected to a power supply terminal of the control gate, and the second electrode of the ink leakage detection unit is electrically connected to a ground terminal of the control gate.

11. A printing apparatus comprising:

a printhead; and a control board electrically connected to the printhead, wherein the printhead comprises:

a print element substrate that includes a print element; and a circuit board electrically connected to the print element substrate, wherein an ink leakage detection unit that includes a first electrode and a second electrode and that is configured to detect ink leakage is provided on the circuit board, and at least one of the first electrode and the second electrode is electrically connected to a terminal of the print element substrate, wherein the print element substrate includes a temperature detection unit configured to detect a temperature of the print element substrate, the temperature detection unit includes a first terminal and a second terminal, the first electrode of the ink leakage detection unit is connected to the first terminal of the temperature detection unit, and the second electrode of the ink leakage detection unit is connected to the second terminal of the temperature detection unit, wherein the control board includes a control circuit and a power supply circuit configured to generate a power supply voltage applied to the printhead, and the control circuit blocks an output of the power supply circuit if a potential difference between the first terminal and the second terminal of the temperature detection unit falls outside a predetermined range.

12. The printing apparatus according to claim 11, wherein the temperature detection unit has a negative temperature characteristic in which a terminal voltage decreases as temperature increases.

13. The printing apparatus according to claim 12, wherein the temperature detection unit is a diode element.

14. The printing apparatus according to claim 13, wherein the first terminal is an anode terminal of the diode element, and the second terminal is a cathode terminal of the diode element.

15. A printing apparatus comprising:

a printhead; and a control board electrically connected to the printhead, wherein the printhead comprises:

a print element substrate that includes a print element; and a circuit board electrically connected to the print element substrate, wherein an ink leakage detection unit that includes a first electrode and a second electrode and that is configured to detect ink leakage is provided on the circuit board, and at least one of the first electrode and the second electrode is electrically connected to a terminal of the print element substrate, wherein the print element substrate includes a driving element configured to drive the print element, a control gate configured to control the driving element, and a logic circuit configured to send a control signal to the control gate, the first electrode of the ink leakage detection unit is connected to a power supply terminal of the logic circuit, and the second electrode of the ink leakage detection unit is connected to a ground terminal of the logic circuit, wherein the control board includes a leakage current detection circuit and a power supply circuit configured to generate a power supply voltage applied to the printhead, and the leakage current detection circuit blocks an output of the power supply circuit if a current at the power supply terminal of the logic circuit falls outside a predetermined range.

16. A printing apparatus comprising:

a printhead; and a control board electrically connected to the printhead, wherein the printhead comprises:

a print element substrate that includes a print element; and a circuit board electrically connected to the print element substrate, wherein an ink leakage detection unit that includes a first electrode and a second electrode and that is configured to detect ink leakage is provided on the circuit board, and at least one of the first electrode and the second electrode is electrically connected to a terminal of the print element substrate, wherein the print element substrate includes a driving element configured to drive the print element, a control gate configured to control the driving element, and a logic circuit configured to send a control signal to the control gate, and the first electrode of the ink leakage detection unit is connected to a power supply terminal of the control gate, and the second electrode of the ink leakage detection unit is connected to a ground terminal of the control gate, wherein the control board includes a leakage current detection circuit and a power supply circuit configured to generate a power supply voltage applied to the printhead, and the leakage current detection circuit blocks an output of the power supply circuit if a current at the power supply terminal of the control gate falls outside a predetermined range.

17. A printing apparatus comprising:

a printhead; and a control board electrically connected to the printhead, wherein the printhead comprises:

a print element substrate that includes a detection unit configured to detect a state of the print element substrate, and a circuit board that includes an ink leakage detection unit configured to detect ink leakage and that is electrically connected to the print element substrate and the control board, the control board includes a control circuit and a power supply circuit configured to generate a power supply voltage applied to the printhead, and based on a change in output of the ink leakage detection unit and a change in output by the detection unit, the control circuit can control an output of the power supply circuit.

* * * * *